US006871029B2

(12) United States Patent
Brewington et al.

(10) Patent No.: US 6,871,029 B2
(45) Date of Patent: Mar. 22, 2005

(54) PROCESS FOR MINIMIZING TONER USAGE IN MINIMUM AREA COVERAGE PATCHES AND MINIMIZING TONER CHURNING

(75) Inventors: Grace T. Brewington, Fairport, NY (US); Robert E. Grace, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 43 days.

(21) Appl. No.: 10/425,104

(22) Filed: Apr. 28, 2003

(65) Prior Publication Data

US 2004/0213593 A1 Oct. 28, 2004

(51) Int. Cl.[7] ..... G03G 15/08
(52) U.S. Cl. ..... 399/27; 399/30; 399/53
(58) Field of Search ..... 399/27, 28, 29, 399/30, 53

(56) References Cited

U.S. PATENT DOCUMENTS 5,153,658 A * 10/1992 Lundy et al.
6,047,142 A 4/2000 Donaldson ..... 399/27
6,167,214 A * 12/2000 Scheuer et al. ..... 399/27
6,173,133 B1 * 1/2001 Donaldson et al. ..... 399/27
6,505,832 B2 1/2003 Moore et al. ..... 271/265.01
6,580,879 B2 * 6/2003 Coleman et al. ..... 399/27

* cited by examiner

*Primary Examiner*—Arthur T. Grimley
*Assistant Examiner*—Ryan Gleitz
(74) *Attorney, Agent, or Firm*—Lloyd Bean, II

(57) ABSTRACT

A method for minimizing toner usage in minimum area coverage patches in a color printer including: reviewing a print job including job images; performing a pixel count for each color plane on a sheet level of the print job; converting the pixel count to a percent area coverage per color plane; in feed-forward mode comparing the area coverage per color plane to a reference value; activating or inactivating a color station depending on the comparison of the area coverage per color plane to the reference value; and printing a MAC patch of variable size with the color station if the area coverage per color plane is substantially less than a reference value.

24 Claims, 7 Drawing Sheets

PROCESS FOR MINIMIZING TONER USAGE IN MINIMUM AREA COVERAGE PATCHES AND MINIMIZING TONER CHURNING

FIELD OF THE INVENTION

The present invention generally relates to a digital imaging system. More specifically, the present invention provides an improved method and apparatus for maintaining toner age to ensure image quality by anticipating or diagnosing problems in image quality, which may be caused by toner age. These problems include low developability, high background, and halo defects appearing on sheets of support material. The present invention minimizes toner usage in minimum area coverage patches by feed-forward control, and minimizes toner aging in the developer housing.

BACKGROUND OF THE INVENTION

Modern electronic copiers, printers, facsimile machines, etc. are capable of producing complex and interesting page images. The pages may include text, graphics, and scanned or computer generated images. The image of a page may be described as a collection of simple image components or primitives (characters, lines, bitmaps, colors, etc.). Complex pages can then be built by specifying a large number of the basic image primitives. This is done in software using a page description language such as POSTSCRIPT™. The job of the electronic printer's software is to receive and interpret each of the imaging primitives for the page. The drawing, or rasterization must be done on an internal, electronic model of the page. All image components must be collected and the final page image must be assembled before marking can begin. The electronic model of the page is often constructed in a data structure called an image buffer. The data contained is in the form of an array of color values called pixels. Each actual page and the pixel's value provides the color which should be used when marking. The pixels are organized to reflect the geometric relation of their corresponding spots. They are usually ordered to provide easy access in the raster pattern required for marking.

In the prior art, a copier, printer or other document-generating device typically employs an initial step of charging a photoconductive member to substantially uniform potential. The charged surface of the photoconductive member is thereafter exposed to a light image of an original document to selectively dissipate the charge thereon in selected areas irradiated by the light image. This procedure records an electrostatic latent image on the photoconductive member corresponding to the informational areas contained within the original document being reproduced. The latent image is then developed by bringing a developer material including toner particles adhering triboelectrically to carrier granules into contact with the latent image. The toner particles are attracted away from the carrier granules to the latent image, forming a toner image on the photoconductive member, which is subsequently transferred to a copy sheet. The copy sheet having the toner image thereon is then advanced to a fusing station for permanently affixing the toner image to the copy sheet.

The approach utilized for multicolor electrophotographic printing is substantially identical to the process described above. However, rather than forming a single latent image on the photoconductive surface in order to reproduce an original document, as in the case of black and white printing, multiple latent images corresponding to color separations are sequentially recorded on the photoconductive surface. Each single color electrostatic latent image is developed with toner of a color corresponding thereto and the process is repeated for differently colored images with the respective toner of corresponding color. Thereafter, each single color toner image can be transferred to the copy sheet in superimposed registration with the prior toner image, creating a multi-layered toner image on the copy sheet. Finally, this multi-layered toner image is permanently affixed to the copy sheet in substantially conventional manner to form a finished copy.

With the increase in use and flexibility of printing machines, especially color printing machines which print with two or more different to colored toners, it has become increasingly important to monitor the toner development process so that increased print quality, stability and control requirements can be met and maintained. For example, it is very important for each component color of a multi-color image to be stably formed at the correct toner density because any deviation from the correct toner density may be visible in the final composite image. Additionally, deviations from desired toner densities may also cause visible defects in mono-color images, particularly when such images are half-tone images. Therefore, many methods have been developed to monitor the toner development process to detect present or prevent future image quality problems.

For example, it is known to monitor the developed mass per unit area (DMA) for a toner development process by using densitometers such as infrared densitometers (IRDs) to measure the mass of a toner process control patch formed on an imaging member. IRDs measure total developed mass (i.e., on the imaging member), which is a function of developablitiy and electrostatics. Electrostatic voltages are measured using a sensor such as an ElectroStatic Voltmeter (ESV). Developability is the rate at which development (toner mass/area) takes place. The rate is usually a function of the toner concentration in the developer housing. Toner concentration (TC) is measured by directly measuring the percentage of toner in the developer housing (which, as is well known, contains toner and carrier particles).

As indicated above, the development process is typically monitored (and thereby controlled) by measuring the mass of a toner process control patch and by measuring toner concentration (TC) in the developer housing. However, the relationship between TC and developability is affected by other variables such as ambient temperature, humidity and the age of the toner. For example, a three-percent TC results in different developabilities depending on the variables listed above. Therefore, in order to ensure good developability, which is necessary to provide high quality images, toner age must be considered.

Consequently, there is a need to provide a method and apparatus for calculating or determining toner age to ensure image quality by anticipating or diagnosing problems in image quality, which may be caused by toner age. These problems include low developability, high background, and halo defects appearing on sheets of support material. One method of managing the residence time of toner in the developer housing is to use a minimum area coverage (MAC) patch in the inter-page zone to cause a minimum amount of toner throughput which is disclosed in U.S. Pat. No. 6,047,142 which is hereby incorporated by reference. However there is a drawback with this solution in that toner throughput is increased resulting in raising the consumables cost and Total Cost of Ownership (TCO) of the system. Thus minimizing the excess toner throughput is important for print shop cost control.

SUMMARY OF THE INVENTION

In accordance with the invention, there is provided a method for minimizing toner usage in minimum area coverage patches in a color printer comprising: reviewing a print job comprising job images; performing a pixel count for each color plane on a sheet level of the print job; converting the pixel count to a percent area coverage per color plane; in feed-forward mode comparing the area coverage per color plane to a reference value; activating or inactivating a color station depending on the comparison of the area coverage per color plane to the reference value; and printing a MAC patch with said color station if the area coverage per color plane is substantially less than a reference value.

There is also provided an electrostatic printing machine having a plurality of color station having a system for producing control patches wherein said system employs a method for reducing toner usage in producing said control patches comprising: reviewing a print job comprising job images; performing a pixel count for each color plane on a sheet level of the print job; converting the pixel count to a percent area coverage per color plane; in feed-forward mode comparing the area coverage per color plane to a reference value; activating or inactivating a color station depending on the comparison of the area coverage per color plane to the reference value; and printing a MAC patch with said color station if the area coverage per color plane is substantially less than a reference value.

DETAILED DESCRIPTION OF THE PRESENT INVENTION

Figure 1:
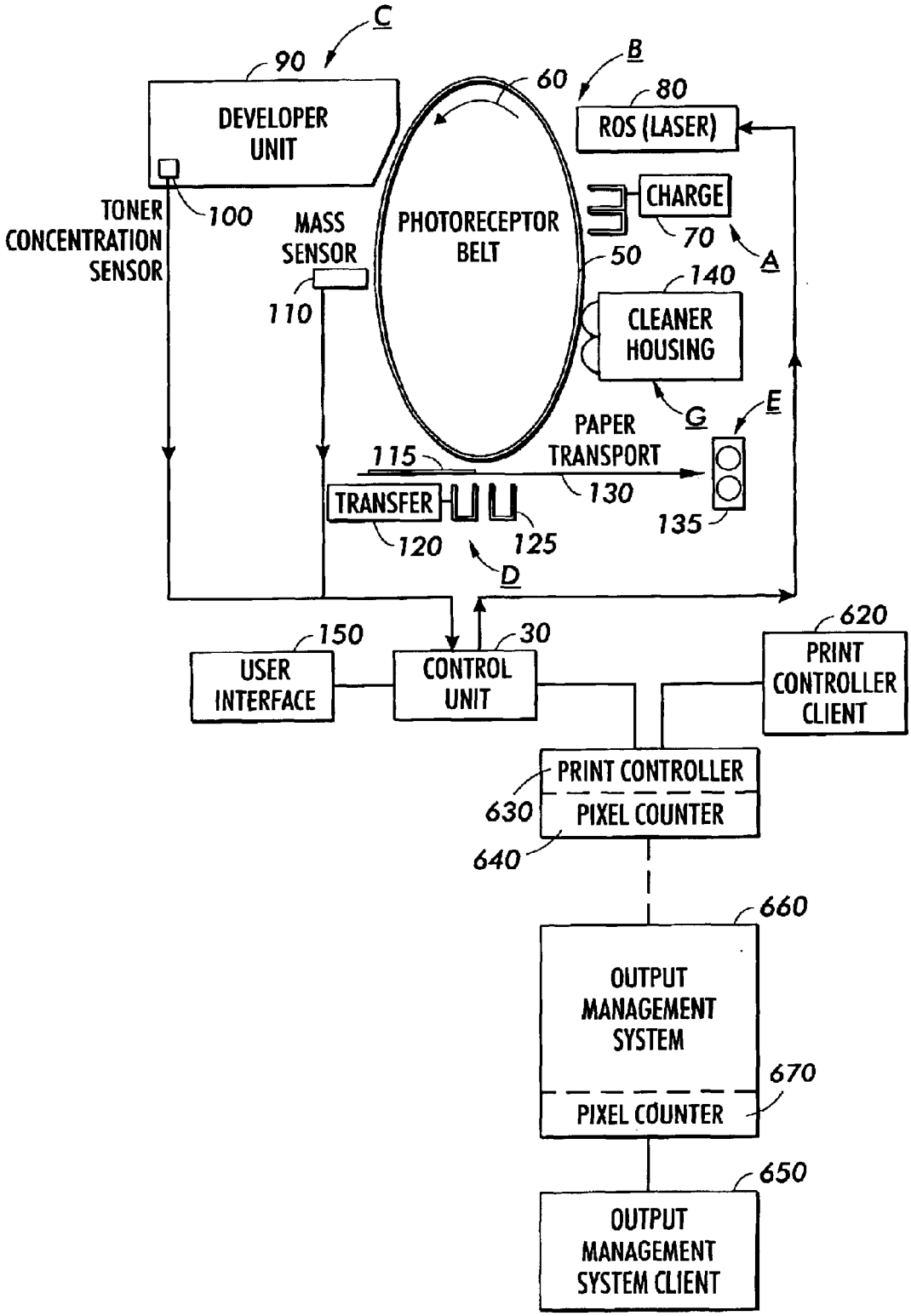
FIG. 1 is a partial schematic of an example of a print engine for a digital imaging system, which can employ the minimum area coverage patch of the present invention.

FIG. 1 shows a partial schematic of an example of a printing system or digital imaging system. Printing jobs are submitted from the Print Controller Client 620 to the Print Controller 630. A pixel counter 640 is incorporated into the Print Controller to count the number of pixels to be imaged with toner on each sheet or page of the job, for each color. The pixel count information is stored in the Print Controller memory. Job control information, including the pixel count data, and digital image data are communicated from the Print Controller 630 to the Control Unit 30. The digital image data represent the desired output image to be imparted on at least one sheet. The Control Unit 30 may be a microprocessor or other control device.

FIG. 1 additionally shows an alternative embodiment in which an Output Management System 660 may supply printing jobs to the Print Controller 630. Printing jobs may be submitted from the Output Management System Client 650 to the Output Management System 660. A pixel counter 670 is incorporated into the Output Management System 660 to count the number of pixels to be imaged with toner on each sheet or page of the job; for each color. The pixel count information is stored in the Output Management System memory. The Output Management System 660 submits job control information, including the pixel count data, and the printing job to the Print Controller 630. Job control information, including the pixel count data, and digital image data are communicated from the Print Controller 630 to the Control Unit 30. In this alternative embodiment, pixel counting in the Print Controller 630 is not necessary since the data has been provided with the job control information from the Output Management System 660.

A photoreceptor belt 50 advances sequentially through various xerographic process stations in the direction indicated by arrow 60. Other types of photoreceptors such as a photoreceptor drum may be substituted for the photoreceptor belt 50 for sequentially advancing through the xerographic process stations. A portion of the photoreceptor belt 50 passes through charging station A, where a charging unit 70 charges the photoconductive surface of photoreceptor belt 50 to a substantially uniform potential. Preferably, charging unit 70 is a corona-generating device such as a dicorotron.

Subsequently, the charged portion of photoreceptor belt 50 is advanced through imaging/exposure station B. The control unit 30 receives the digital image data from at least one Print Controller. The control unit 30 processes and transmits these digital image data to an exposure device, which is preferably a raster output scanner 80 located at imaging/exposure station B. However, other xerographic exposure devices such as a plurality of light emitting diodes (an LED bar) could be used in place of the raster output scanner 80. The raster output scanner (ROS) 80 causes the charge retentive surface of the photoreceptor belt 50 to be discharged at certain locations on the photoreceptor belt 50 in accordance with the digital image data output from the digital image generating device. Thus, a latent image is formed on photoreceptor belt 50.

Next, the photoreceptor belt 50 advances the latent image to a development station C, where toner is electrostatically attracted to the latent image using commonly known techniques. The latent image attracts toner particles from the carrier granules in a developer unit 90 forming a toner powder image thereon. Alternatively, the developer unit 90 may utilize a hybrid development system, in which the developer roll, better known as the donor roll, is powered by two developer fields (potentials across the air gap). The first field is the ac field which is used for toner cloud generation. The second field is the dc developer field which is used to control the amount of developed toner mass on the photoreceptor belt 50. Appropriate developer biasing is accomplished by way of a power supply. This type of system is a noncontact type in which only toner particles are attracted to a latent image and there is no mechanical contact between the photoreceptor belt 50 and the toner delivery device. However, the present invention can be utilized in a contact system as well. In accordance with the present invention, the developer unit 90 includes a toner concentration sensor 100, such as a packer toner concentration sensor, for sensing toner concentration (TC). A mass sensor 110 such as an enhanced toner area coverage (ETAC) sensor, measures developed mass per unit area.

Subsequent to image development, a sheet of support material 115 is moved into contact with toner images at transfer station D. The sheet of support material 115 is advanced to transfer station D by any known sheet feeding apparatus (not shown). The sheet of support material 115 is then brought into contact with the photoconductive surface of photoreceptor belt 50 in a timed sequence so that the toner powder image developed thereon contacts the advancing sheet of support material 115 at transfer station D. Transfer station D preferably includes a transfer unit 120. Transfer unit 120 includes a corona-generating device, which is preferably a dicorotron. The corona-generating device sprays ions onto the backside of sheet of support material 115. This attracts the oppositely charged toner particle images from the photoreceptor belt 50 onto the sheet of support material 115. A detack unit 125 (preferably a detack dicorotron) is provided for facilitating stripping of the sheet of support material 115 from the photoreceptor belt 50.

After transfer, the sheet of support material 115 continues to advance toward fuser station E on a conveyor belt (not shown) in the direction of arrow 130. Fuser station E includes a fuser unit 135, which includes fuser and pressure rollers to permanently affix the image to the sheet of support material 115. After fusing, a chute, not shown, guides the advancing sheets of support material 115 to a catch tray, stacker, finisher or other output device (not shown), for subsequent removal from the print engine by the operator.

After the sheet of support material 115 is separated from photoconductive surface of photoreceptor belt 50, the residual toner particles carried by the non-image areas on the photoconductive surface are removed therefrom. These particles are removed at cleaning station G, using, for example, a cleaning brush or plural brush structure contained in a cleaner housing 140. However, the cleaning station G may utilize any number of well known cleaning systems.

Control unit 30 regulates the various print engine functions. The control unit 30 is preferably a programmable controller (such as a microprocessor), which controls the print engine functions hereinbefore described. The control unit 30 may provide a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by an operator. Moreover, the control unit 30 reads or receives information from sensors such as toner concentration sensor 100 and mass sensor 110 for calculating toner age in order to predict or diagnose degradation in image quality. Based on this calculation, an appropriate action may be taken to restore image quality or prevent degradation in image quality before it occurs.

Figure 2:
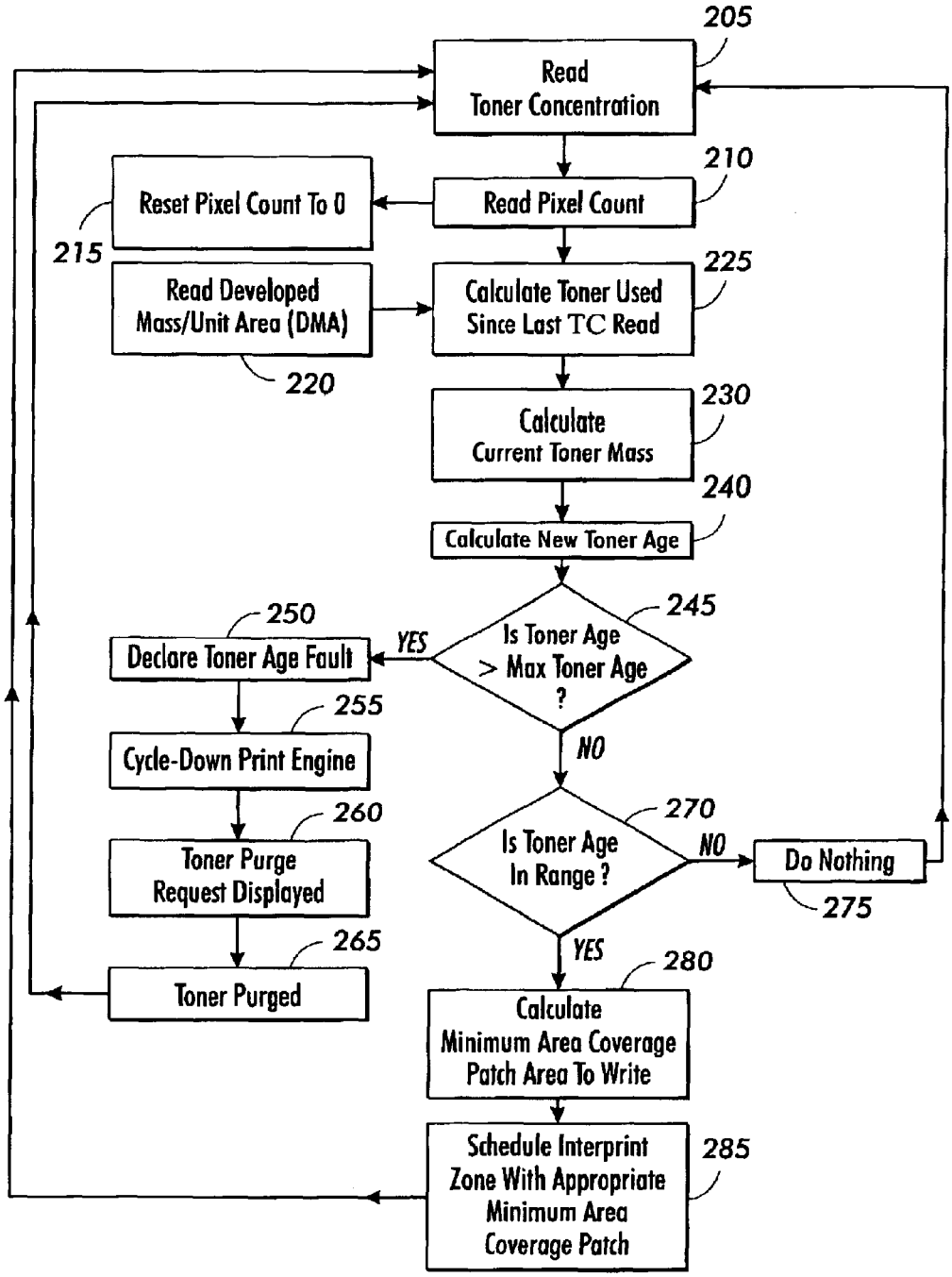
FIG. 2 is a flow chart showing the toner age calculation.

Now referring to FIG. 2 which is a flow chart showing the process that calculates toner age and takes appropriate action based upon the results of the toner age calculation. Preferably, the control unit 30 reads the toner concentration (TC) every n seconds, wherein n is a positive number, and this number is stored in memory (step 205). The control unit 30 reads the pixel count (step 210), and the pixel counter is reset to zero (step 215). The control unit 30 reads the developed mass per unit area (DMA), sensed by mass sensor 110, and stores the DMA in memory (step 220). The control unit 30 calculates the toner amount used since the last toner concentration was read (step 225) by using the DMA stored in memory.

The toner amount used since the last toner concentration was read is calculated using the following formula:

$$\text{Toner Used}=(\text{pixel count}*\text{developed mass per unit area})*(\text{unit area/pixels}) \quad \text{(Equation 1).}$$

For example, in a six hundred dots per inch (dpi) print engine, unit area per pixels would equal one inch squared divided by 600 pixels squared. Subsequently, the current toner mass in developer unit 90 is calculated by control unit 30 (step 230) by using the following formula:

$$\text{Current Toner Mass}=(\text{toner concentration}/100)*\text{carrier mass} \quad \text{(Equation 2)}$$

The carrier mass varies depending upon the print engine, and is generally determined by the manufacturer based on a number of factors including size of print engine, toner stability, speed of print engine, etc.

Then, the new toner age is calculated by the control unit 30 (step 240) using the following formula:

$$\text{New Toner Age}=[(\text{Current Toner Mass}-\text{Toner Used})*(\text{Previous Toner Age}+n\ \text{seconds}*\text{prints/second})]/\text{Current Toner Mass} \quad \text{(Equation 3)}$$

After the new toner age is calculated, the new toner age is compared to a predetermined maximum toner age, which is based on the appearance of image defects (step 245). An image is considered defective when the quality of the image does not meet predetermined customer, user or manufacturer print quality standards. If the current toner age is greater than the maximum toner age, then the control unit 30 recognizes a toner age fault and interrupts the current job (step 250). The print engine is cycled down (step 255), and a toner purge routine request is displayed at a user interface 150 (step 260). A toner purge routine may then be initiated by an operator of the print engine to purge the toner in the developer unit 90 to stop or prevent unacceptable print quality (step 265). The toner age continues to be recalculated during the toner purge routine, as in run-time, except that during the purge routine an out-of-range toner age does not trigger a fault or shut down the print engine. The toner purge routine decreases the toner age, for example, by running a high area coverage image. At the end of the toner purge routine, the operator may reinitiate the interrupted job.

If the new toner age is less than the predetermined maximum toner age, then the new toner age is compared to a predetermined toner age range (step 270). If the new toner age is less than a predetermined minimum toner age in the toner age range, the quality of the images is not affected by toner age (step 275). The toner age calculation process is repeated at the next scheduled toner concentration read by returning to step 205. The predetermined minimum toner age is based on a variety of factors including cost to customer, productivity and image quality.

If the new toner age falls within the toner age range, then a minimum area coverage (MAC) patch area is calculated based on the current toner age (step 280). The preferred MAC patch calculation minimizes toner usage and maximizes print engine productivity, while ensuring that toner age is maintained within the safe range, avoiding the necessity for toner purging and job interruption. The MAC patch area may be calculated automatically based on toner age in a number of different ways such as utilizing a look-up table. An interprint zone with appropriate MAC patch(es) is scheduled (step 285).

Figure 3:
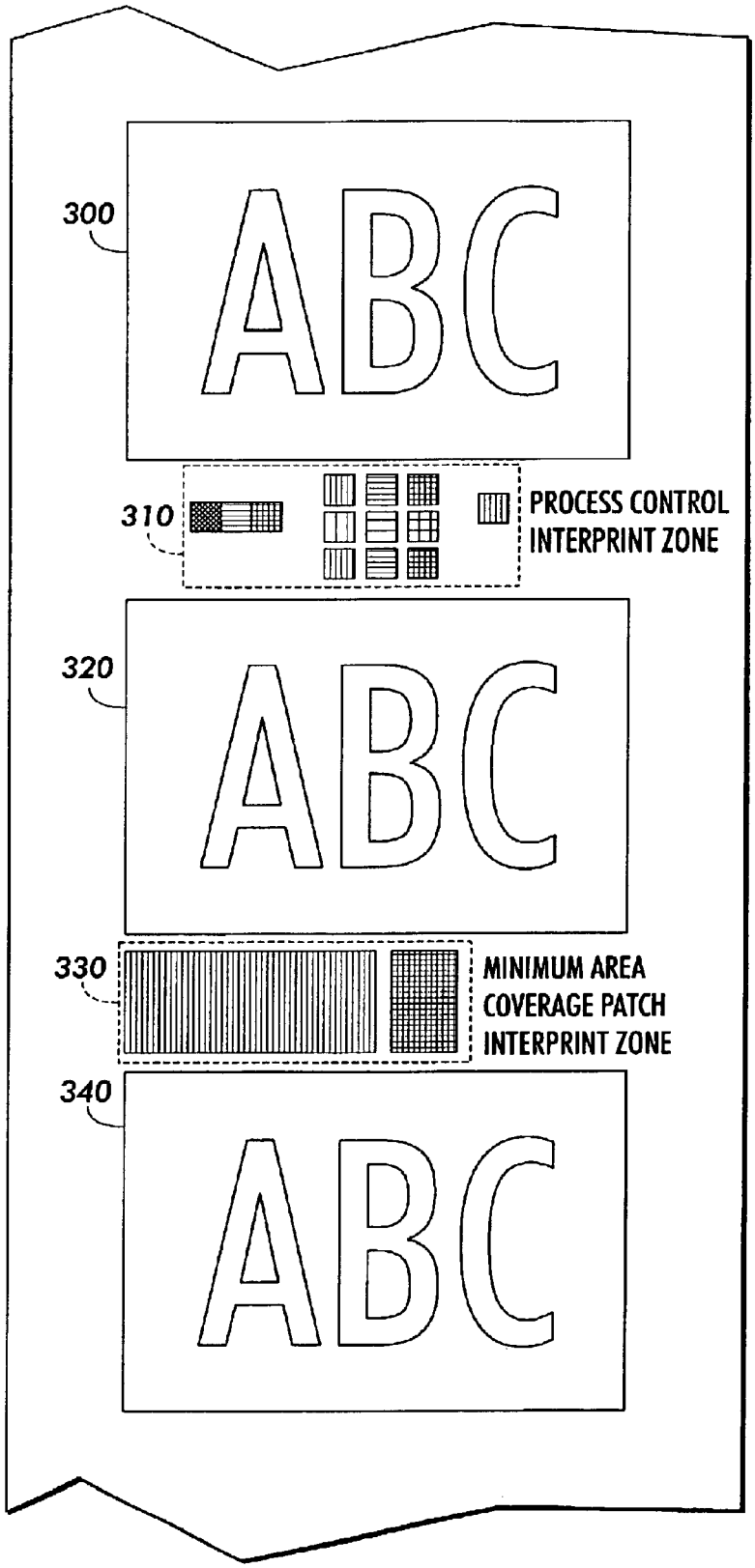
FIG. 3 is a layout showing one implementation of customer images, process control patches and MAC patches on a photoreceptor.

FIG. 3 shows one example of a layout of customer images, process control patches and MAC patches on a photoconductive surface (e.g. surface of photoreceptive belt 50) over time. A print zone on the surface dedicated to the customer image 300 is followed by an interprint zone 310 in which control patches are laid out to be read by electrostatic or development sensors. Another customer image 320 is laid out, followed by an interprint zone 330 in which one or more MAC patches are laid out, for the purpose of maintaining toner age. In FIG. 3, the MAC patch interprint zone 330 contains patches for two different colors. The MAC patch interprint zone is followed by another customer image 340. It is understood that FIG. 3 is just one example of the many different types of layouts that can be utilized.

Figure 4:
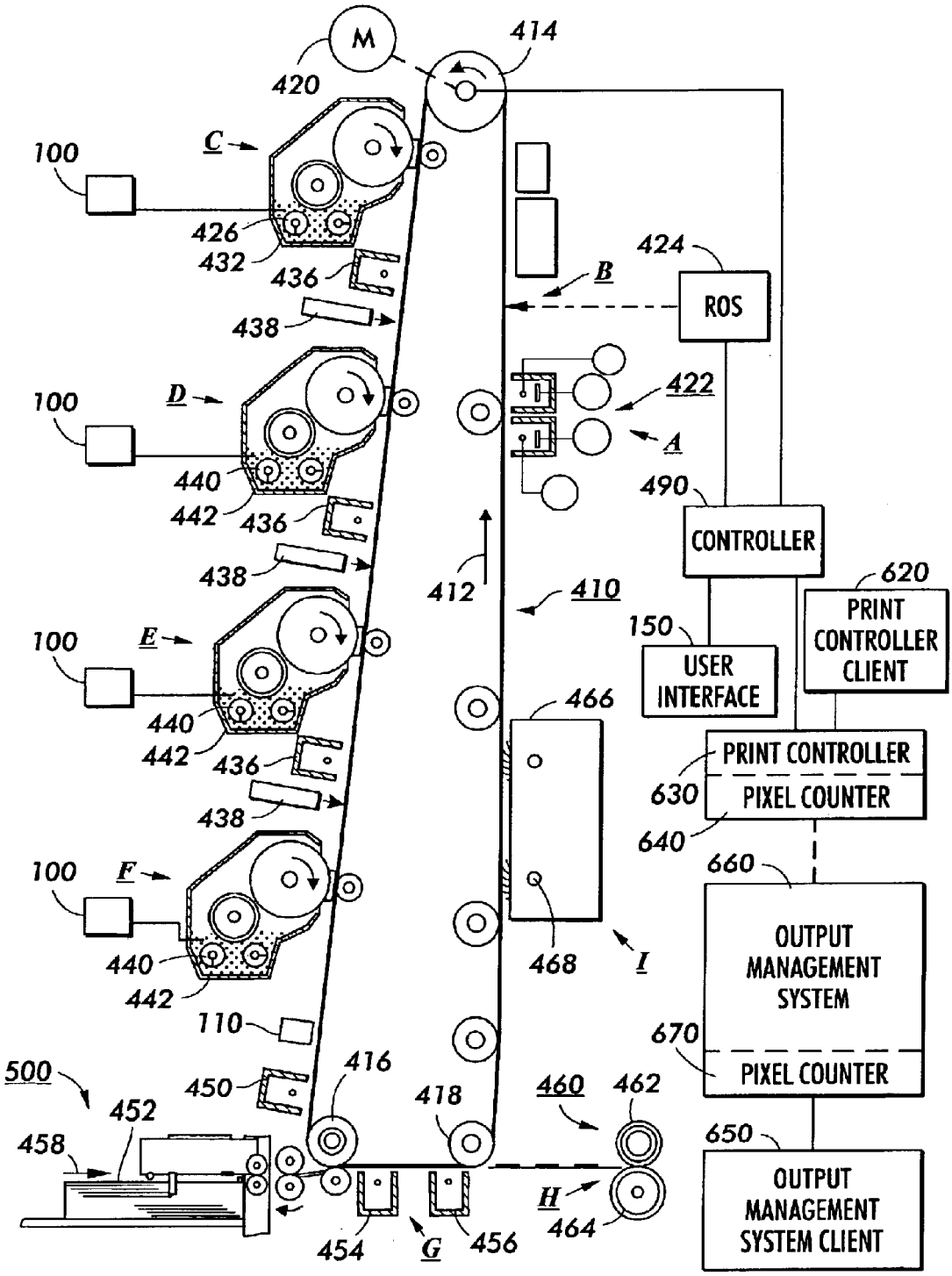
FIG. 4 is a partial schematic elevational view of another example of a digital imaging system, which can employ the minimum area coverage patch of the present invention.

FIG. 4 is a partial schematic view of a digital imaging system, such as the digital imaging system of U.S. Pat. No. 6,505,832, which may utilize the toner age calculation process and apparatus of the present invention. The imaging system is used to produce color output in a single pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass color process system, a single or multiple pass highlight color system, and a black and white printing system.

In this embodiment, printing jobs are submitted from the Print Controller Client 620 to the Print Controller 630. A pixel counter 640 is incorporated into the Print Controller to count the number of pixels to be imaged with toner on each sheet or page of the job, for each color. The pixel count information is stored in the Print Controller memory. Job control information, including the pixel count data, and digital image data are communicated from the Print Controller 630 to the Controller 490. The digital image data represent the desired output image to be imparted on at least one sheet.

FIG. 4 additionally shows an alternative embodiment in which an Output Management System 660 may supply printing jobs to the Print Controller 630. Printing jobs may be submitted from the Output Management System Client 650 to the Output Management System 660. A pixel counter 670 is incorporated into the Output Management System 660 to count the number of pixels to be imaged with toner on each sheet or page of the job, for each color. The pixel count information is stored in the Output Management System memory. The Output Management System 660 submits job control information, including the pixel count data, and the printing job to the Print Controller 630. Job control information, including the pixel count data, and digital image data are communicated from the Print Controller 630 to the Controller 490. In this alternative embodiment, pixel counting in the Print Controller 630 is riot necessary since the data has been provided with the job control information from the Output Management System 660.

The printing system preferably uses a charge retentive surface in the form of an Active Matrix (AMAT) photoreceptor belt 410 supported for movement in the direction indicated by arrow 412, for advancing sequentially through the various xerographic process stations. The belt is entrained about a drive roller 414, tension roller 416 and fixed roller 418 and the drive roller 414 is operatively connected to a drive motor 420 for effecting movement of the belt through the xerographic stations. A portion of belt 410 passes through charging station A where a corona generating device, indicated generally by the reference numeral 422, charges the photoconductive surface of photoreceptor belt 410 to a relatively high, substantially uniform, preferably negative potential.

Next, the charged portion of photoconductive surface is advanced through an imaging/exposure station B. At imaging/exposure station B, a controller, indicated generally by reference numeral 490, receives the image signals from Print Controller 630 representing the desired output image and processes these signals to convert them to signals transmitted to a laser based output scanning device, which causes the charge retentive surface to be discharged in accordance with the output from the scanning device. Preferably the scanning device is a laser Raster Output Scanner (ROS) 424. Alternatively, the ROS 424 could be replaced by other xerographic exposure devices such as LED arrays.

The photoreceptor belt 410, which is initially charged to a voltage $V_0$, undergoes dark decay to a level equal to about −500 volts. When exposed at the exposure station B, it is discharged to a level equal to about 50 volts. Thus after exposure, the photoreceptor belt 410 contains a monopolar voltage profile of high and low voltages, the former corresponding to charged areas and the latter corresponding to discharged or background areas.

At a first development station C, developer structure, indicated generally by the reference numeral 432 utilizing a hybrid development system, the developer roller, better known as the donor roller, is powered by two developer fields (potentials across an air gap). The first field is the ac field which is used for toner cloud generation. The second field is the dc developer field which is used to control the amount of developed toner mass on the photoreceptor belt 410. The toner cloud causes charged toner particles 426 to be attracted to the electrostatic latent image. Appropriate developer biasing is accomplished via a power supply. This type of system is a noncontact type in which only toner particles (black, for example) are attracted to the latent image and there is no mechanical contact between the photoreceptor belt 410 and a toner delivery device to disturb a previously developed, but unfixed, image. A toner concentration sensor 100 senses the toner concentration in the developer structure 432.

The developed but unfixed image is then transported past a second charging device 436 where the photoreceptor belt 410 and previously developed toner image areas are recharged to a predetermined level.

A second exposure/imaging is performed by device 438 which comprises a laser based output structure is utilized for selectively discharging the photoreceptor belt 410 on toned areas and/or bare areas, pursuant to the image to be developed with the second color toner. At this point, the photoreceptor belt 410 contains toned and untoned areas at relatively high voltage levels and toned and untoned areas at relatively low voltage levels. These low voltage areas represent image areas which are developed using discharged area development (DAD). To this end, a negatively charged, developer material 440 comprising color toner is employed. The toner, which by way of example may be yellow, is contained in a developer housing structure 442 disposed at a second developer station D and is presented to the latent images on the photoreceptor belt 410 by way of a second developer system. A power supply (not shown) serves to electrically bias the developer structure to a level effective to develop the discharged image areas with negatively charged yellow toner particles 440. Further, a toner concentration sensor 100 senses the toner concentration in the developer housing structure 442.

The above procedure is repeated for a third image for a third suitable color toner such as magenta (station E) and for a fourth image and suitable color toner such as cyan (station F). The exposure control scheme described below may be utilized for these subsequent imaging steps. In this manner a full color composite toner image is developed on the photoreceptor belt 410. In addition, a mass sensor 110 measures developed mass per unit area. Although only one mass sensor 110 is shown in FIG. 4, there may be more than one mass sensor 110.

To the extent to which some toner charge is totally neutralized, or the polarity reversed, thereby causing the composite image developed on the photoreceptor belt 410 to consist of both positive and negative toner, a negative pre-transfer dicorotron member 450 is provided to condition the toner for effective transfer to a substrate using positive corona discharge.

Subsequent to image development a sheet of support material 452 is moved into contact with the toner images at transfer station G. The sheet of support material 452 is advanced to transfer station G by a sheet feeding apparatus 500, described in detail below. The sheet of support material 452 is then brought into contact with photoconductive surface of photoreceptor belt 410 in a timed sequence so that the toner powder image developed thereon contacts the advancing sheet of support material 452 at transfer station G.

Transfer station G includes a transfer dicorotron 454 which sprays positive ions onto the backside of sheet 452. This attracts the negatively charged toner powder images from the photoreceptor belt 410 to sheet 452. A detack dicorotron 456 is provided for facilitating stripping of the sheets from the photoreceptor belt 410.

After transfer, the sheet of support material 452 continues to move, in the direction of arrow 458, onto a conveyor (not shown) which advances the sheet to fusing station H. Fusing station H includes a fuser assembly, indicated generally by the reference numeral 460, which permanently affixes the transferred powder image to sheet 452. Preferably, fuser assembly 460 comprises a heated fuser roller 462 and a backup or pressure roller 464. Sheet 452 passes between fuser roller 462 and backup roller 464 with the toner powder image contacting fuser roller 462. In this manner, the toner powder images are permanently affixed to sheet 452. After fusing, a chute, not shown, guides the advancing sheet 452 to a catch tray, stacker, finisher or other output device (not shown), for subsequent removal from the printing machine by the operator.

After the sheet of support material 452 is separated from photoconductive surface of photoreceptor belt 410, the residual toner particles carried by the non-image areas on the photoconductive surface are removed therefrom. These particles are removed at cleaning station I using a cleaning brush or plural brush structure contained in a housing 466. The cleaning brush 468 or brushes 468 are engaged after the composite toner image is transferred to a sheet. Once the photoreceptor belt 410 is cleaned the brushes 468 are retracted utilizing a device incorporating a clutch (not shown) so that the next imaging and development cycle can begin.

Controller 490 regulates the various printer functions. The controller 490 is preferably a programmable controller, which controls printer functions hereinbefore described. The controller 490 may provide a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by an operator. Conventional sheet path sensors or switches may be utilized to keep track of the position of the document and the copy sheets.

The steps in the flow chart in FIG. 2 are repeated for each developer in FIG. 4 to measure the toner age. After the new toner age is calculated, the new toner age is compared to a predetermined maximum toner age, which is based on a variety of factors including cost to customer, productivity and image quality. (step 245).

If the current toner age is greater than the maximum toner age, then the control unit 490 recognizes a toner age fault and interrupts the current job (step 250). The print engine is cycled down (step 255) and a toner purge routine request is displayed at a user interface 150 (step 260). When an operator initiates the toner purge routine, the toner age continues to be recalculated during the toner purge routine, as in run-time, except that during the purge routine an out-of-range toner age does not trigger a fault or shut down the print engine. The toner purge routine decreases the toner age, for example, by running a high area coverage image. At the end of the toner purge routine, the operator may reinitiate the interrupted job.

If the new toner age is less than the predetermined maximum toner age, then the new toner age is compared to a predetermined toner age range (step 270). If the new toner age is less than the predetermined minimum toner age in the toner age range, the quality of the images is not affected by toner age (step 275). The toner age calculation process is repeated at the next scheduled toner concentration read by returning to step 205. The predetermined minimum toner age is based on a variety of factors including cost to customer, productivity and image quality.

If the new toner age falls within the toner age range, then a MAC patch area is calculated based on the current toner age (step 280). The preferred MAC patch calculation minimizes toner usage and maximizes print engine productivity, while ensuring that toner age is maintained within the safe range, avoiding the necessity for toner purging and job interruption. The MAC patch area may be calculated automatically based on toner age in a number of different ways such as utilizing a look-up table. An interprint zone with appropriate MAC patch(es) is scheduled (step 285).

Now focusing on the present invention, a process for scheduling appropriate MAC patch(es) is disclosed. The Minimum Area Coverage (MAC) patch is written for each color in the inter-page zone to accommodate the minimum toner throughput requirements for each HSD development station. Thus, in the present invention, performing sheet level pixel counting for each color plane in the Print Controller is disclosed, with feed-forward communication of the pixel count data from the Print Controller to the Print Engine.

Figure 5:
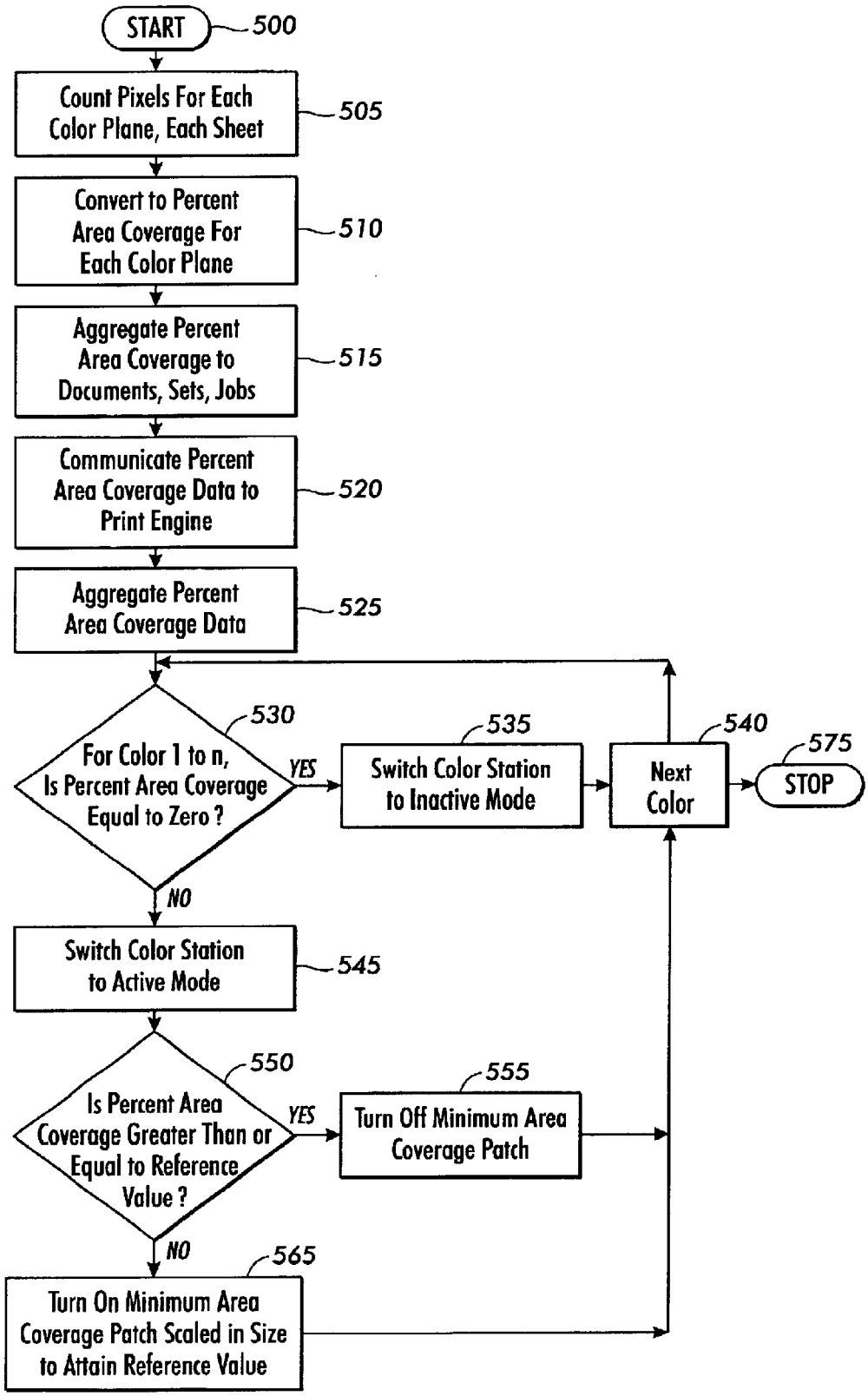
FIG. 5 is a flow chart showing the method of scheduling a MAC patch in accordance with the present invention.

Referring to FIG. 5 which illustrates details of the present invention in regard to the interprint zone with appropriate MAC patch(es) scheduled (step 285). The present invention performs pixel counting for each color plane in the Print Controller on a sheet level (step 505). Next, the Print Controller converts the pixel count to a percent area coverage per color plane (step 510). The Print Controller aggregates percent area coverage to the level of multiple sheets (step 515). Next, the Print Controller communicates the area coverage information to the Controller in the Print Engine in the feed-forward mode (step 520) and the Controller in the Print Engine compares the area coverage data to a reference value (step 530). Next, the Controller in the Print Engine turns the color station to active/inactive mode depending on the comparison of the area coverage data to a reference value. The Controller in the Print Engine turns on/off the Minimum Area Coverage patch depending on the comparison; if the percent area coverage is greater than or equal to the reference value (step 550), then the Minimum Area Coverage patch is turned off (step 555); if not, then the Minimum Area Coverage patch is turned on (step 565) and the size is customized for the sheet or sheet aggregate such that the percent area coverage of the customer image plus the percent area coverage of the patch is equal to the reference value. The aggregation of sheets can be by document, by set, by job, for example. The Controller in the Print Engine may aggregate the percent area coverage data over several documents or jobs (step 525) if per pitch switching of the color station between active and inactive is not desirable or necessary.

The process steps 530–575 are repeated until each color station has been checked on percent area coverage and adjustment has been applied to the Minimum Area Coverage patch if required.

The Minimum Area Coverage patch can be scheduled on/off on a per pitch frequency if necessary. The inactive mode for a color station involves turning off the developer housing or turning the developer housing down to lower speeds for reduced churning on the toner (step 535). The inactive mode for a color station should include turning off all process control patches for that color station, to eliminate this additional source of toner consumption. The Controller for the Print Engine will turn the color station to active mode in time to print customer images; it has at least several sheets of advance warning via the look-ahead communication. The look-ahead communication currently exists in the protocol used between the Print Engine and the Print Controller. Addition of the pixel count data into the communication protocol is part of the present invention. In digital imaging systems with job streaming, there could be advanced warning several jobs ahead of time. The time needed to transition the color station from inactive to active mode is dependent on the characteristics of the inactive mode and the transition method to active mode.

Figure 6:
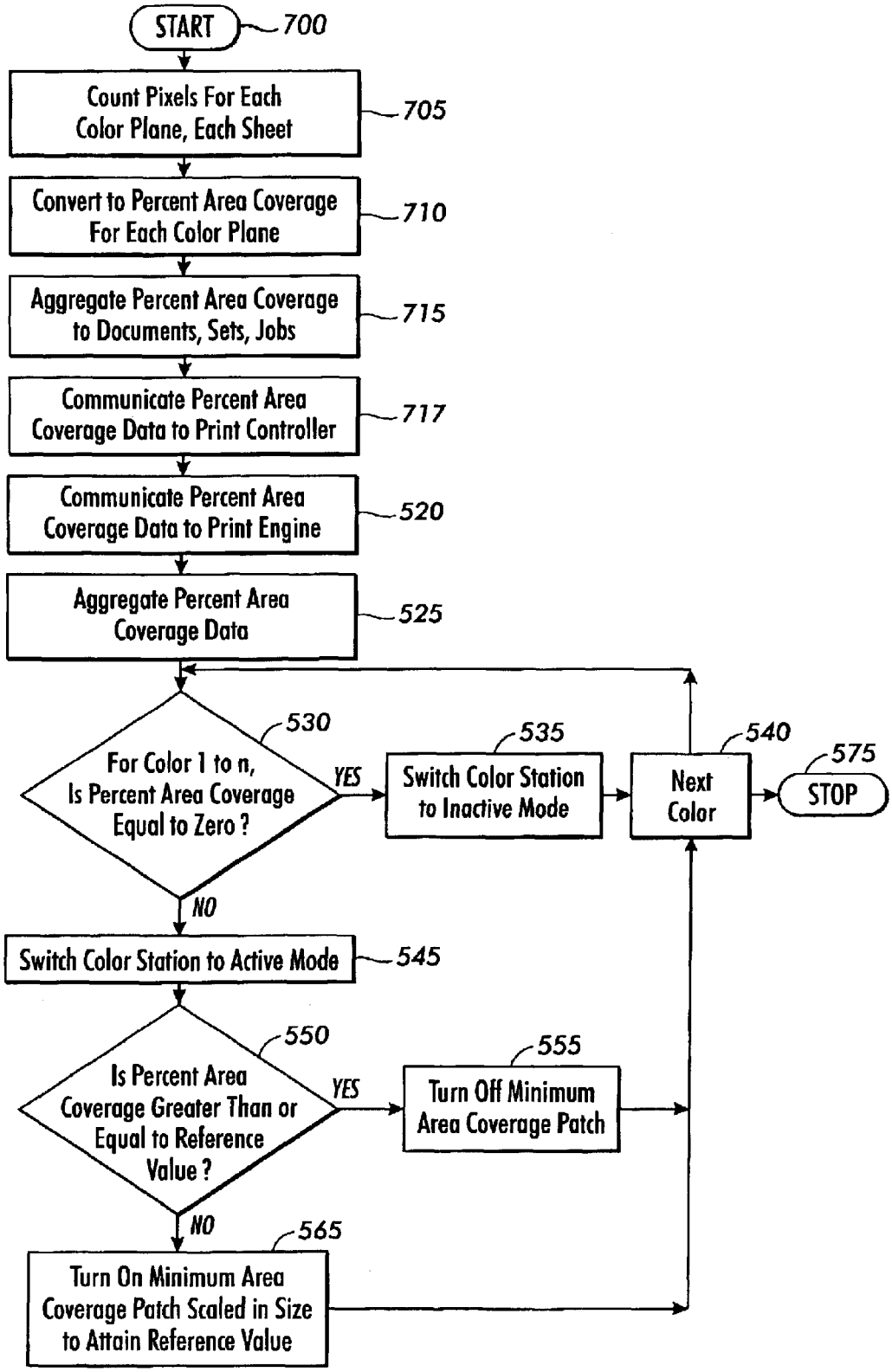
FIG. 6 is a flow chart showing the method of scheduling a MAC patch in accordance with a second embodiment of the present invention.

FIG. 6 illustrates details of an alternative embodiment of the present invention in regard to the interprint zone with appropriate MAC patch(es) scheduled (step 285). The present invention performs pixel counting for each color plane in the Output Management System on a sheet level (step 705). Next, the Output Management System converts the pixel count to a percent area coverage per color plane (step 710). The Output Management System aggregates percent area coverage to the level of multiple sheets (step 715). Next, the Output Management System communicates the area coverage to the Print Controller (step 717).

Following communication of the area coverage to the Print Controller (step 717), the flow is the same as in FIG. 5. The Print Controller communicates the area coverage information to the Controller in the Print Engine in the feed-forward mode (step 520) and the Controller in the Print Engine compares the area coverage data to a reference value (step 530).

Next, the Controller in the Print Engine turns the color station to active/inactive to mode depending on the comparison of the area coverage data to a reference value. The Controller in the Print Engine turns on/off the Minimum Area Coverage patch depending on the comparison; if the percent area coverage is greater than or equal to the reference value (step 550), then the Minimum Area Coverage patch is turned off (step 555); if not, then the Minimum Area is Coverage patch is turned on (step 565) and the size is customized for the sheet or sheet aggregate such that the percent area coverage of the customer image plus the percent area coverage of the patch is equal to the reference value. The aggregation of sheets can be by document, by set, by job, for example. The Controller in the Print Engine may aggregate the percent area coverage data over several documents or jobs (step 525) if per pitch switching of the color station between active and inactive is not desirable or necessary.

The process steps 530–575 are repeated until each color station has been checked on percent area coverage and adjustment has been applied to the Minimum Area Coverage patch if required.

Figure 7:
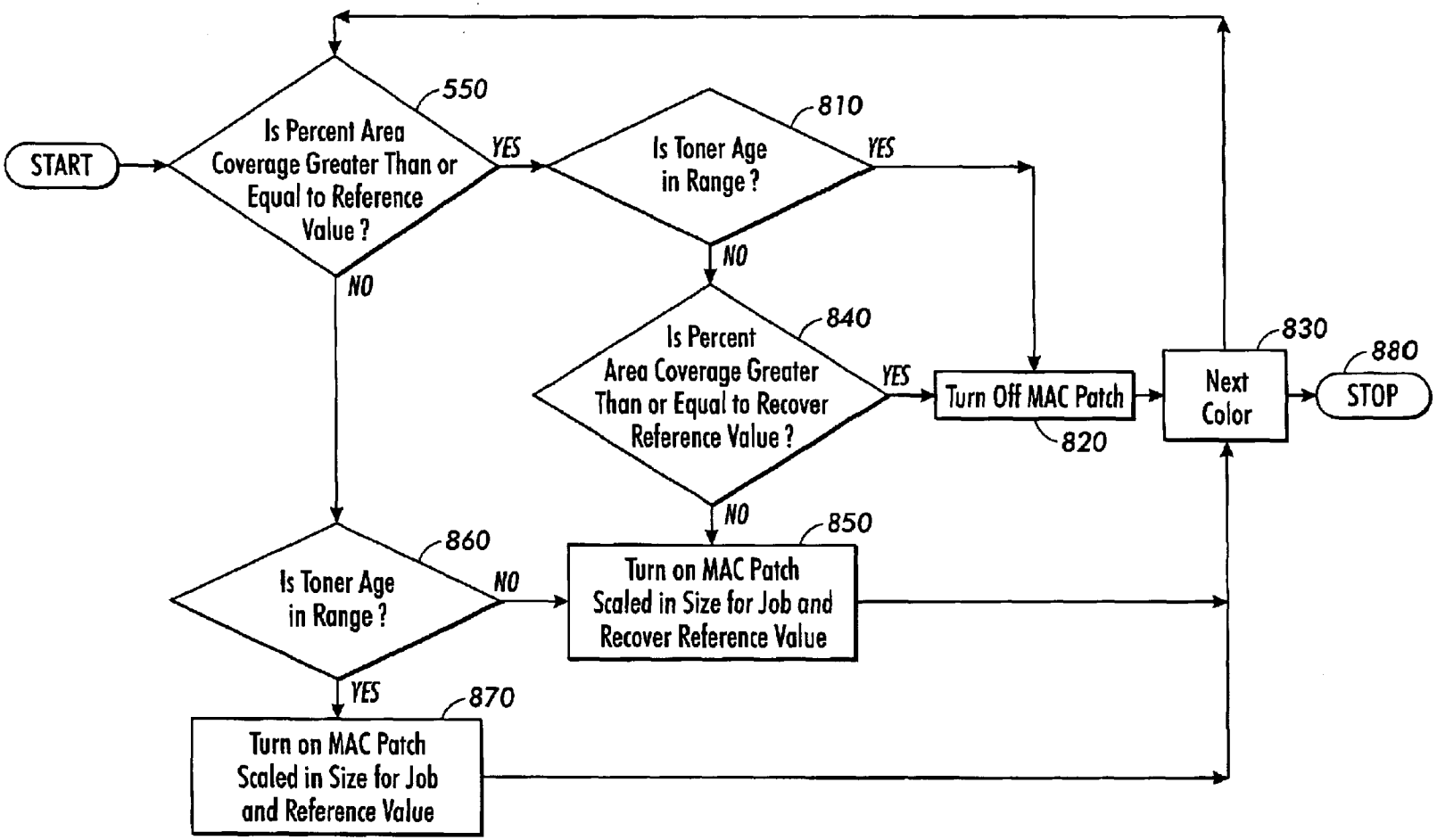
FIG. 7 is a flow chart showing the method of scheduling a MAC patch using the toner age calculation as an input factor, in accordance with the present invention.

FIG. 7 illustrates details of an alternative process to the flows illustrated in FIGS. 5 and 6, starting with the decision "Is Percent Area Coverage Greater than or Equal to Reference Value?" (step 550). FIG. 7 covers the case of toner age falling out of range, even in the presence of the feed forward percent area coverage control. The Controller in the Print Engine compares the area coverage data to a reference value (step 550). If the area coverage data is greater than or equal to the reference value, the Controller in the Print Engine compares the toner age to the predetermined maximum toner age (step 810) and turns off the MAC patch (step 820) if the toner age is less than the maximum toner age.

If the area coverage data is greater than or equal to the reference value (step 550) and the toner age is greater than the maximum toner age (step 810), the area coverage for the incoming job is compared with the Recover reference value (step 840). If the area coverage data is greater than or equal to the Recover reference value, the MAC patch is turned off (step 820). If the area coverage data is less than the Recover reference value (step 840), the MAC patch is turned on (step 850) with size customized such that the percent area coverage of the customer image plus the percent area coverage of the MAC patch is equal to the Recover reference value. The Recover reference value is distinguishable from the area coverage reference value in that the recover reference value is the area coverage for purging when toner age is greater than the maximum tonerage. The area coverage reference value is predetermined to maintain toner age within range for a developer housing that currently has toner age within range.

If the area coverage is less than the reference value (step 550) and the toner age is greater than the maximum toner age (step 860), the MAC patch is turned on (step 850) with size customized such that the percent area coverage of the customer image plus the percent area coverage of the MAC patch is equal to the Recover reference value.

If the area coverage is less than the reference value (step 550) and the toner age is less than the maximum toner age (step 860), the MAC patch is turned on (step 870) customized in size such that the percent area coverage of the customer image plus the percent area coverage of the MAC patch is equal to the reference value.

The process steps 550–880 are repeated until each color station has been checked on percent area coverage and adjustment has been applied to the Minimum Area Coverage patch if required.

While FIGS. 1 and 4 show two examples of a digital imaging system incorporating the toner age calculation of the present invention, it is understood that this process could be used in any digital document reading, generating or reproducing device.

The examples stated herein are representative of the concept; additional implementations using this concept will be apparent to those trained in the art.

While the invention has been described in detail with reference to specific and preferred embodiments, it will be appreciated that various modifications and variations will be apparent to the artisan. All such modifications and embodiments as may occur to one skilled in the art are intended to be within the scope of the appended claims.

We claim:

1. A method for minimizing toner usage in minimum area coverage patches in a color printer comprising:

reviewing a print job comprising job images;

performing a pixel count for each color plane on a sheet level of the print job;

converting the pixel count to a percent area coverage per color plane;

in feed-forward mode comparing the percent area coverage per color plane to a reference value;

activating or inactivating a color station depending on the comparison of the percent area coverage per color plane to the reference value; and printing a MAC patch with said color station of the percent area coverage per color plane is substantially less than a reference value.

2. The method of claim 1, wherein said feed-forward mode comparing includes comparing percent area coverage for an incoming job to the reference value.

3. The method of claim 2, wherein said printing includes customizing the size of said MAC patch such that the percent area coverage of the job images plus the percent area coverage of the MAC patch is substantially equal to the reference value.

4. The method of claim 1, wherein customizing can be based upon aggregating from a group consisting of sheets, document, job sets, or a job.

5. The method of claim 1, wherein converting includes aggregating percent area coverage to a level of multiple sheets.

6. The method of claim 1, wherein said converting includes selecting the color plane from the group consisting of yellow, black, cyan and magenta.

7. The method of claim 1, wherein said activating or inactivating includes comparing toner age in said color station to the predetermined maximum toner age and turning off the MAC patch if the toner age is less than the predetermined maximum toner age.

8. The method of claim 1, wherein said reference value is a coverage reference value.

9. The method of claim 1, wherein said reference value is a recover reference value.

10. The method of claim 9, wherein said activating or inactivating includes activating the MAC patch with size customized such that the percent area coverage of the customer image plus the percent area coverage of the MAC patch is equal to the recover reference value when said percent area coverage is less than the reference value and the toner age is greater than the maximum toner age.

11. The method of claim 8, wherein said activating or inactivating includes activating the MAC patch if the percent area coverage is less than the reference value and the toner age is less than the maximum toner age with MAC patch customized in size such that the percent area coverage of the customer image plus the percent area coverage of the MAC patch is equal to the reference value.

12. The method of claim 1, wherein said activating or inactivating includes switching said color station to an inactive mode if the area coverage for a color plane is equal to zero.

13. An electrostatic printing machine having a plurality of color stations having a system for producing control patches wherein said system employs a method for reducing toner usage in producing said control patches comprising:

reviewing a print job comprising job images;

performing a pixel count for each color plane on a sheet level of the print job;

converting the pixel count to a percent area coverage per color plane;

in feed-forward mode comparing the percent area coverage per color plane to a reference value;

activating or inactivating a color station depending on the comparison of the percent area coverage per color plane to the reference value; and printing a MAC patch with said color station if the percent area coverage per color plane is substantially less than a reference value.

14. The method of claim 13, wherein said in feed-forward mode comparing includes comparing percent area coverage for an incoming job to the reference value.

15. The method of claim 13, wherein said printing includes customizing the size of said MAC patch such that the percent area coverage of the job images plus the percent area coverage of the MAC patch is substantially equal to the reference value.

16. The method of claim 13, wherein customizing can be based upon aggregating from a group consisting of sheets, documents, job sots, or a job.

17. The method of claim 13, wherein converting includes aggregating percent area coverage to a level of multiple sheets.

18. The method of claim 13, wherein said converting includes selecting the color plane from the group consisting of yellow, black, cyan and magenta.

19. The method of claim 13, wherein said activating or inactivating includes comparing toner age in said color station to the predetermined maximum toner age and turning off the MAC patch if the toner age is less than the predetermined maximum toner age.

20. The method of claim 13, wherein said activating or inactivating includes switching said color station to inactive mode if the area coverage for a color plane is equal to zero.

21. The method of claim 13, wherein said reference value is a coverage reference value.

22. The method of claim 13, wherein said reference value is a recover reference value.

23. The method of claim 22, wherein said activating or inactivating includes activating the MAC patch with size customized such that the percent area coverage of a customer image plus the percent area coverage of the MAC patch is equal to the recover reference value when said percent area coverage is less than the reference value and the toner age is greater than the maximum toner age.

24. The method of claim 22, wherein said activating or inactivating includes activating the MAC patch if the area coverage is less than the reference value and the toner age is less than the maximum toner age with MAC patch customized in size such that the percent area coverage of a customer image plus the percent area coverage of the MAC patch is equal to the reference value.

* * * * *